US008333608B2

(12) United States Patent
Ko

(10) Patent No.: US 8,333,608 B2
(45) Date of Patent: Dec. 18, 2012

(54) CABLE CONNECTOR HAVING A LIGHT PIPE HAVING TWO DIFFERENT SECTIONS WITH DIFFERENT COLOR CHARACTERISTICS

(75) Inventor: David Ko, Fullerton, CA (US)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/206,512

(22) Filed: Aug. 10, 2011

(65) Prior Publication Data

US 2012/0040554 A1 Feb. 16, 2012

(30) Foreign Application Priority Data

Aug. 10, 2010 (CN) ..... 2010 0 250410

(51) Int. Cl.
*H01R 3/00* (2006.01)

(52) U.S. Cl. ..... 439/490

(58) Field of Classification Search ..... 439/488–490, 439/55, 449
See application file for complete search history.

(56) References Cited

U.S. PATENT DOCUMENTS

| | | | | |
|---|---|---|---|---|
| 6,165,006 | A * | 12/2000 | Yeh et al. | 439/490 |
| 6,361,357 | B1 * | 3/2002 | Stillwell et al. | 439/490 |
| 7,785,136 | B2 * | 8/2010 | Zhang et al. | 439/490 |
| 2010/0015842 | A1 | 1/2010 | Zhang et al. | |
| 2010/0065326 | A1 * | 3/2010 | Ko | 174/84 R |
| 2010/0291791 | A1 * | 11/2010 | Ko | 439/449 |
| 2011/0086539 | A1 * | 4/2011 | Aguren | 439/490 |
| 2012/0149214 | A1 * | 6/2012 | Zhang et al. | 439/55 |

* cited by examiner

*Primary Examiner* — Chandrika Prasad
(74) *Attorney, Agent, or Firm* — Wei Te Chung; Ming Chieh Chang

(57) ABSTRACT

A cable connector assembly (100) comprises a mating member (3), a printed circuit board (2), a LED (24) attached to the printed circuit board, a cable (6) having a positive wire (61) and a negative wire (62) connected with the mating member, an insulative shell (1), and a light pipe (4). The insulative shell is enclosing the printed circuit board, the cable and the mating member. The light pipe has a first transmitting member (40) and a second transmitting member (45) molded on a rear end of the first transmitting member, the first transmitting member is made of transparent material and the second transmitting member is made of untransparent material.

20 Claims, 6 Drawing Sheets

CABLE CONNECTOR HAVING A LIGHT PIPE HAVING TWO DIFFERENT SECTIONS WITH DIFFERENT COLOR CHARACTERISTICS

BACKGROUND OF THE INVENTION

1. Field of the Invention

The present invention generally relates to a cable connector assembly, and more particularly to a cable connector assembly transmitting power signal.

2. Description of Related Art

Nowadays, cable connector assemblies are widely used in an electronic equipment, especially for transmitting power, and the performance of the cable connector assembly directly impacts on the entire electronic equipment whether can normally run.

U.S. patent Pub. No. 20100015842 A1 discloses a conventional cable connector assembly, the cable connector assembly comprises a printed circuit board, a Light Emitting Diode (LED) attached to the printed circuit board to indicate the working status of the cable connector assembly, a light pipe receiving the LED, a cable with a plurality of wires, a plurality of contacts connected with the cable, a columnar mating member, and an insulated shell enclosing the printed circuit board, the LED, the light pipe and the mating member partially. The light pipe has a visible area exposed out of the insulated shell, as the light pipe is made of transparent material, the visible area will show a blue halo whether the cable connector assembly works or not, so users can't distinguish the work status of the cable connector assembly.

Hence, it is desirable to have an improved structure to overcome the above-mentioned disadvantages of the prior art.

BRIEF SUMMARY OF THE INVENTION

Accordingly, the object of the present invention is to provide a cable connector assembly with an improved light pipe and a method for producing the cable connector assembly.

In order to achieve the above-mentioned object, a cable connector assembly in accordance with the present invention comprises a mating member, a printed circuit board, a LED attached to the printed circuit board, a cable having a positive wire and a negative wire connected with the mating member, an insulative shell, and a light pipe. The insulative shell is enclosing the printed circuit board, the cable and the mating member. The light pipe has a first transmitting member and a second transmitting member molded on a rear end of the first transmitting member, the first transmitting member is made of transparent material and the second transmitting member is made of untransparent material.

Other objects, advantages and novel features of the invention will become more apparent from the following detailed description of the present embodiment when taken in conjunction with the accompanying drawings.

DETAILED DESCRIPTION OF THE INVENTION

Figure 1:
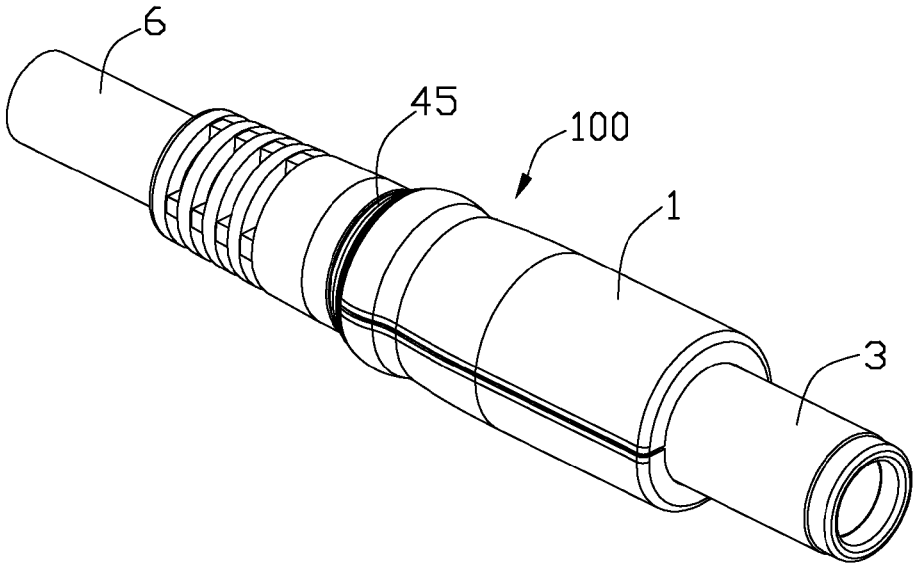
FIG. 1 is an assembled perspective view of a cable connector assembly in accordance with the present invention.

Reference will now be made to the drawing figures to describe the present invention in detail.

Figure 2:
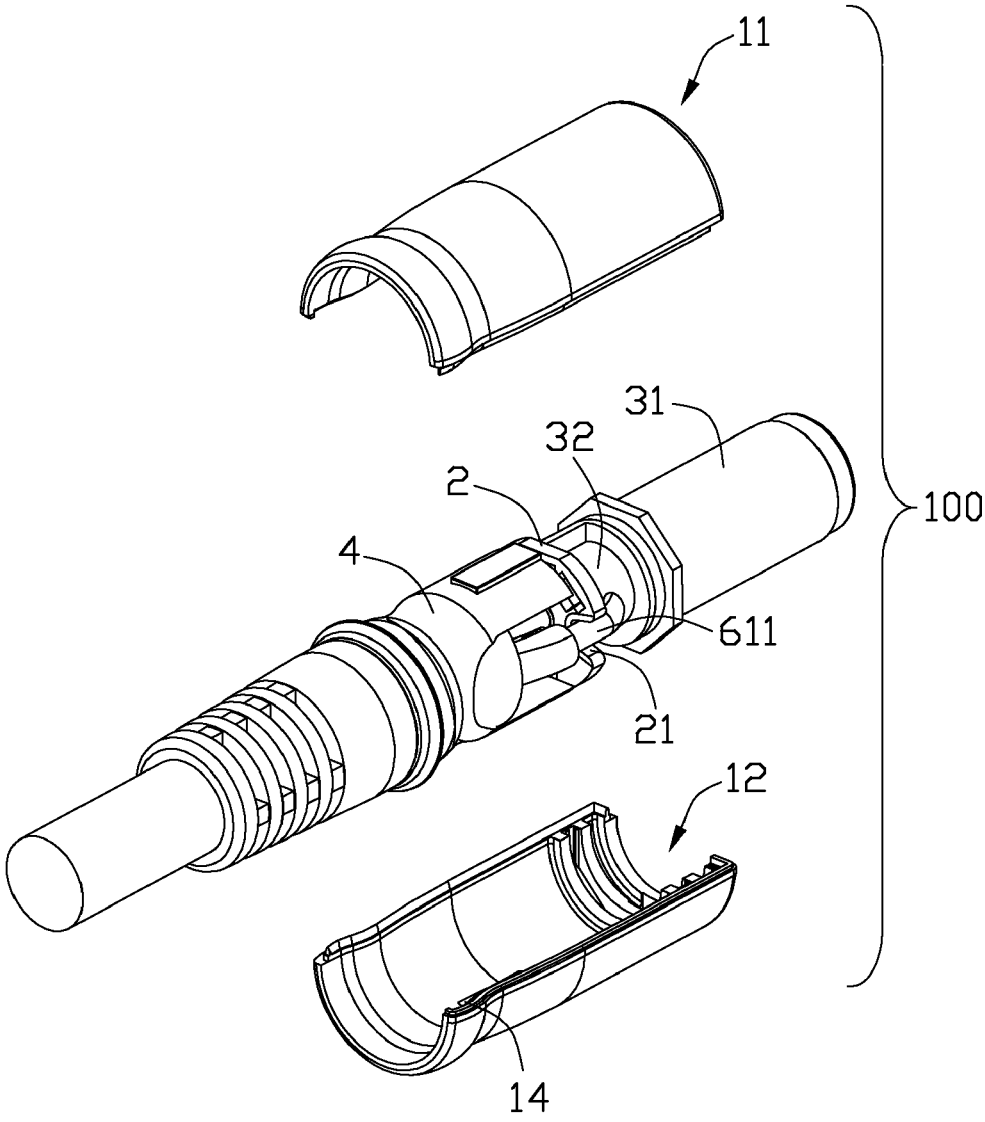
FIG. 2 is a partially exploded perspective view of the cable connector assembly shown in FIG. 1.
Figure 3:
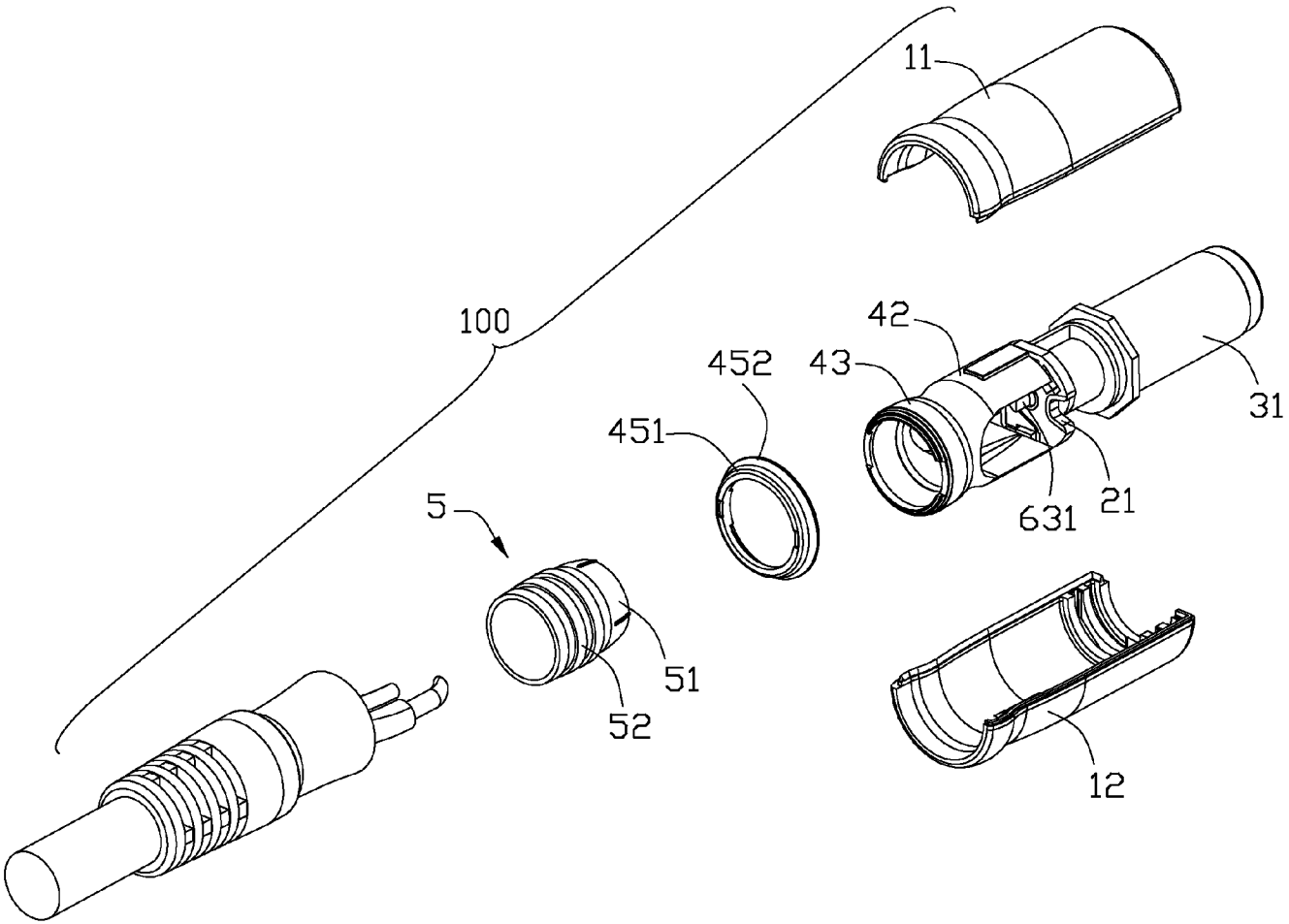
FIG. 3 is a further exploded perspective view of the cable connector assembly shown in FIG. 2.

Referring to FIGS. 1-3, a cable connector assembly 100 made in accordance with the present invention comprises a printed circuit board 2 perpendicular to a mating direction, a cylindrical mating member 3, a light pipe 4, a cable 6 with a plurality of wires, and an insulative shell 1 enclosing the aforementioned components.

Figure 4:
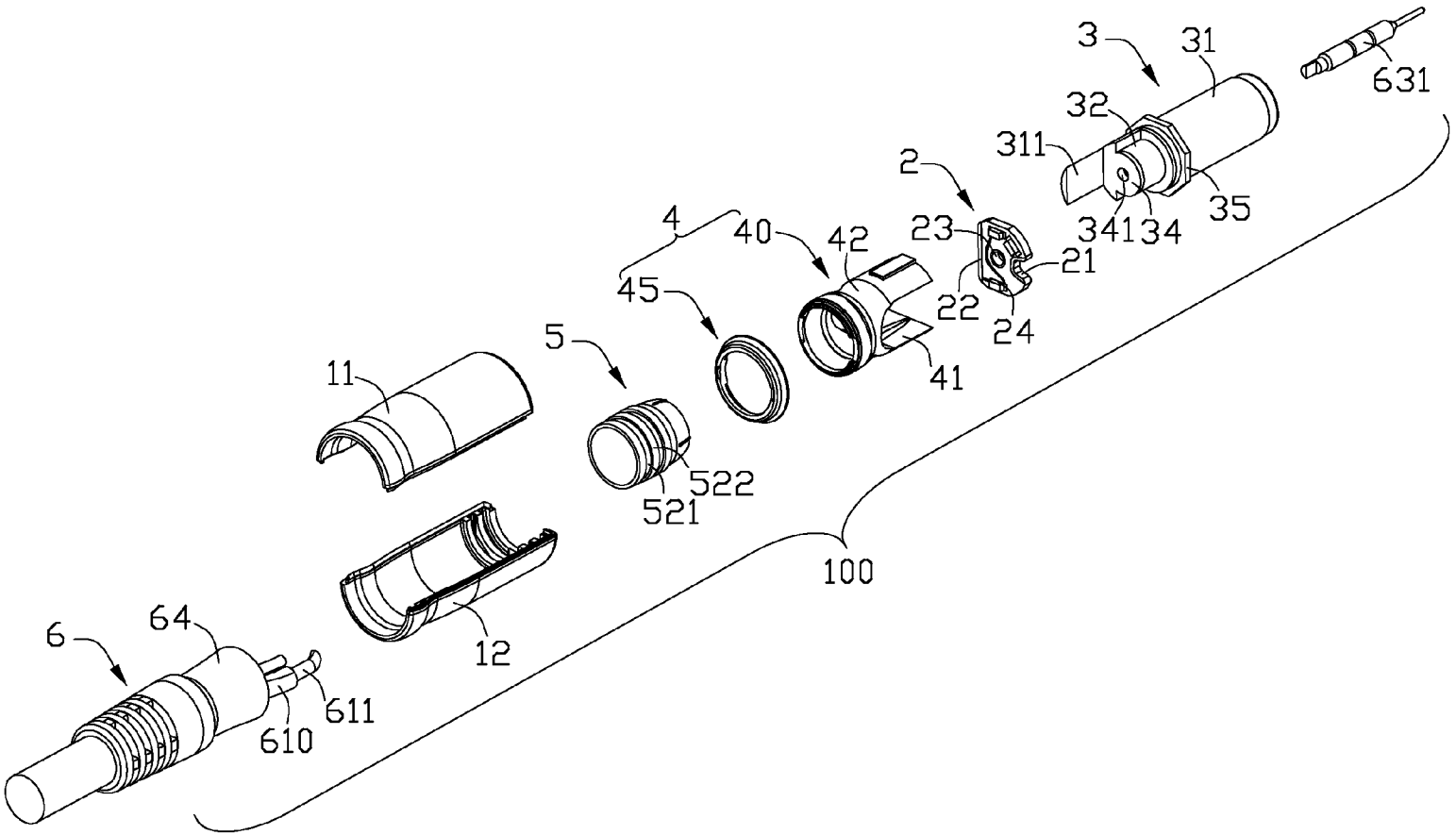
FIG. 4 is an exploded perspective view of the cable connector assembly shown in FIG. 1.
Figure 5:
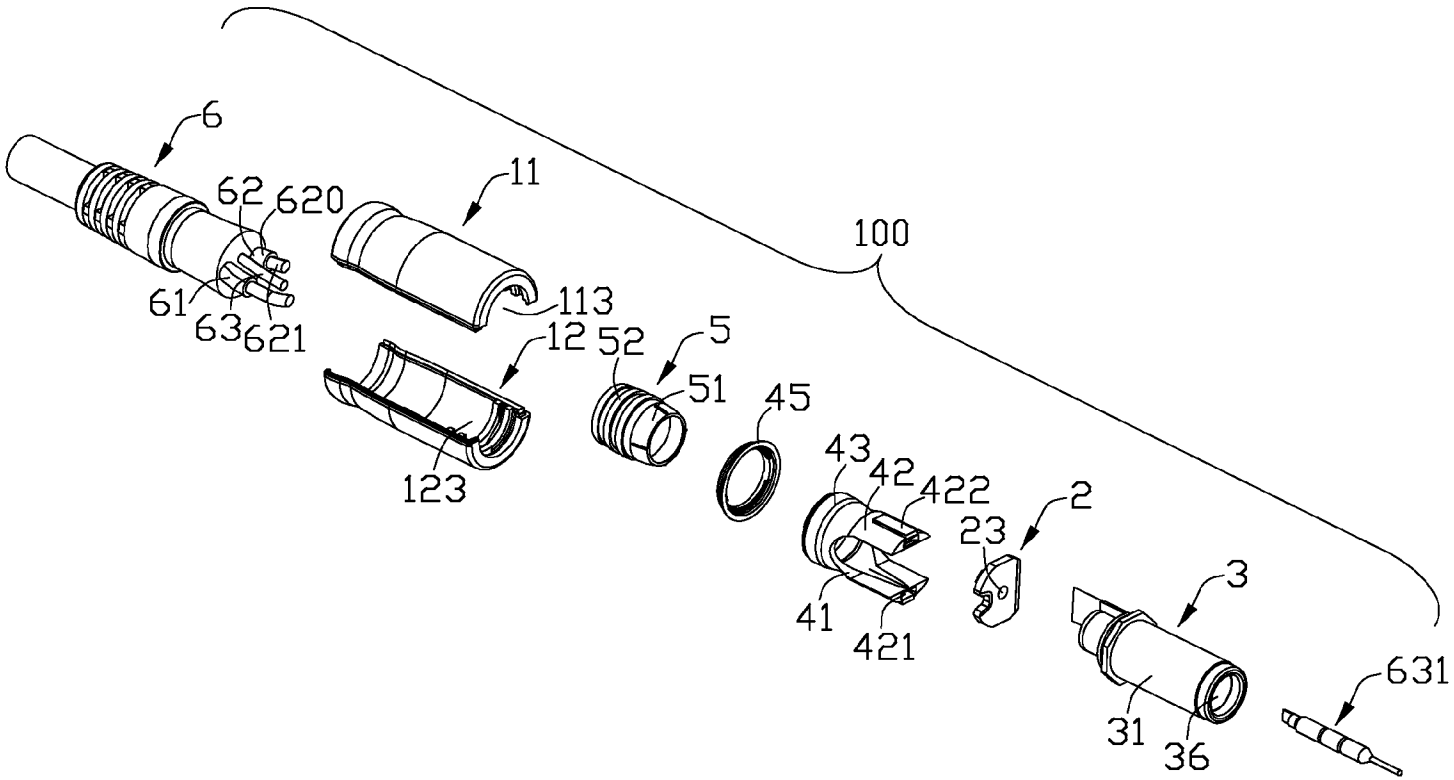
FIG. 5 is a view similar to FIG. 4, but viewed from a different angle.

Referring to FIGS. 4-5, the insulative shell 1 has a hollowed configuration with a cylindrical shape, and is configured with a bottom shell 11 and a top shell 12. The bottom shell 11 defines a first semicircular hole 113 recessed downwardly, the bottom shell 12 is symmetrical to the top shell 11 in shape, the top shell 12 has a second semicircular hole 123 together with the first semicircular hole 113 to form a circular hole. Both of the top shell 11 and the bottom shell 12 define a rectangle groove 14 respectively.

The printed circuit board 2 is arranged in the insulative shell 1 along a direction vertical to the mating direction, the mating member 3 and the cable 6 are located on opposite sides of the printed circuit board 2. The printed circuit board 2 comprises a first conductive area 21 and a second conductive area 22 disposed on opposite edges thereof, the first conductive area 21 is arranged in an aperture (not numbered), and the second conductive area 22 is disposed on an upright side. The first and second conductive areas 21, 22 can be defined with other shapes in other alternative embodiments, such as a curved shape or round in shape. The printed circuit board 2 also has a central hole 23 defined through a center thereof and a Light Emitting Diode (LED) 24 used for indicating the work status of the cable connector assembly 100.

The cylindrical mating member 3 comprises a hollowed mating section 31 in a front end thereof, a polygonal flange 35 surrounding the cylindrical mating member 3, and a positive tube 32 located behind the polygonal flange 35 and communicated with an inner wall 36 of the cylindrical mating member 3. The mating section 31 serves as a negative portion of the mating member 3 and is isolated from the positive tube 32 by an insulator 34. The insulator 34 defines a through hole 341 in a center axis thereof along the pluggable direction, the through hole 341 is aligning with the central hole 23 of the printed circuit board 2 along the mating direction. A linking portion 311 is extending backwards from the mating section 31 on the side corresponding to the second conductive area 22 of the printed circuit board 2.

The light pipe 4 is of fork-shape, and made by means of secondary forming to transmit the light from the LED 24. The light pipe 4 includes a first transmitting member 40 and a second transmitting member 45 located behind the first transmitting member 40, and the second transmitting member 45 is of ringed shape. The first transmitting member 40 is also a hollowed configuration and defines two U-shaped cutouts 41 through the light pipe 4 along a direction perpendicular to the mating direction, and a pair of parallel protrusions 42 are formed on both sides of the cutouts 41. The protrusion 42 is adjacent to the LED 24 of the printed circuit board 2. A block member (not shown) is inserted into the light pipe 4 through the cutouts 41 to prevent the melting insulative material from reaching the LED 24 on the printed circuit board 2 when a strain relief is injection molded over the cable. The protrusions 42 are vertical to the printed circuit board 2 in the cable connector assembly 100, each protrusion 42 has a recess 421 in the surface neighboring to the printed circuit board 2, and the recesses 421 are aligning with the corresponding LED 24 respectively. Each protrusion 42 defines a slick arc surface on an exterior side and a slick plane on an interior side, so to make the light to the protrusions 42 homogeneous. Each protrusion 42 defines a gibbous block 422 on the exterior side thereof to be received in the rectangle groove 14 of the insulative shell 1.

The first transmitting member 40 also has a sleeve portion 43 connecting with the protrusions 42, and the sleeve portion 43 is connected with the second transmitting member 45 by a rear end thereof The second transmitting member 45 comprises a base portion 451 and an enlarged portion 452 extending forwards from the base portion 451, the enlarged portion 452 has a larger diameter than the base portion 451. The second transmitting member 45 is a visible component indicating the status of the LED 24 for users looking at. The first transmitting member 40 is made of transparent plastic material firstly, and then the second transmitting member 45 is molded on the rear end of the sleeve portion 43 by untransparent or translucent plastic material, that is to say, the first transmitting member 40 and the second transmitting member 45 are formed twice, and the enlarged portion 452 is shielding the rear end of the sleeve portion 43. In the preferred embodiment of the invention, the second transmitting member 45 is made of gray plastic material.

The ring member 5 is made of plastic material with light color, and includes a slick loop portion 51 on a front end thereof and a retaining portion 52 behind the loop portion 51, said retaining portion 52 is defined with a rugged exterior surface. The retaining portion 52 has a larger length than the loop portion 51, and the retaining portion 52 defines a plurality of tubers 522 and a plurality of channels 521 alternately. Said loop portion 51 has an external diameter becoming more and more large along a front-to-back direction, so as to the ring member 5 can be inserted into the light pipe 4 easily. And said tubers 522 have bigger external diameters than the loop portion 51 on a rear end thereof.

The cable 6 comprises a fuscous strain relief portion 64 for releasing stress, a positive wire 61 and a negative wire 62 extending forwardly from the strain relief portion 64, and a middle wire 63 located between the positive wire 61 and negative wire 62, and the middle wire 63 is connected and soldered with a detective contact 631. The positive wire 61 and negative wire 62 respectively have inner conductors 611, 621 and outer jackets 610, 620 with part of the corresponding outer jackets 610, 620 stripped away from front ends thereof.

Figure 6:
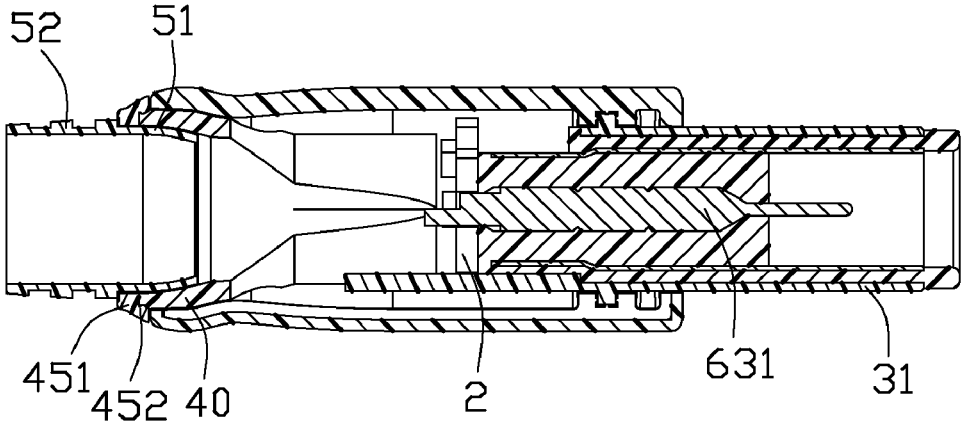
FIG. 6 is a cross-section view of the cable connector assembly shown in FIG. 1.

Referring to FIGS. 2-3 and conjunction with FIG. 6, in assembling, the cylindrical mating member 3 is electrically connected with the cable 6, the detective contact 631 is accommodated in the through hole 341 of the mating member 3 and inserted into the central hole 23 of the printed circuit board 2, then the middle wire 63 is soldered to the detective contact 631. The inner conductor 611 of the positive wire 61 is soldered to the first conductive area 21 of the printed circuit board 2, and front end of inner conductor 611 is soldered to the positive tube 32 of the mating member 3. The linking portion 311 of the mating member 3 is soldered to the second conductive area 22 of the printed circuit board 2, and the inner conductor 621 of the negative wire 62 is soldered to the linking portion 311. The light pipe 4 is closed in insulative shell 1 with the gibbous blocks 422 received in the rectangle groove 14 of the insulative shell 1, and the LED 24 is aligning with the recess 421 and received in it, the light pipe 4 is enclosing the electrical connection between the cable 6 and the detective contact 631.

The loop portion 51 of the ring member 5 is located in the light pipe 4 and arranged neighboring to an internal wall of the light pipe 4, and the retaining portion 52 is located out of the light pipe 4. The loop portion 51 of the ring member 5 is located on an interior side of the second transmitting member 45 of the light pipe 4 and aligning with the second transmitting member 45, the ring member 5 is enclosed in the strain relief portion 64 of the cable 6. When the strain relief portion 64 is over-molded onto the ring member 5, as the retaining portion 52 of the ring member 5 has an enough length with tubers 522 and channels 521 in stagger relationship, such configuration can enhance the engagement between the ring member 5 and the strain relief portion 64, so the cable connector assembly 100 can work longer normally.

Then the top shell 12 is assembled to the bottom shell 11 to enclose the mating member 3 and other components mentioned formerly, the second transmitting member 45 of the light pipe 4 is exposed out of the insulative shell 1 to indicate the work status of the cable connector assembly 100. Thus, the cable connector assembly 100 is assembled. As the second transmitting member 45 is made of gray material, the second transmitting member 45 will show a dark vision while the cable connector assembly 100 does not work, and the second transmitting member 45 will show a blue halo while the cable connector assembly 100 works normally.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a mating member;

a printed circuit board;

a LED attached to the printed circuit board;

a cable having a positive wire and a negative wire connected with the mating member;

an insulative shell enclosing the printed circuit board, the cable and the mating member; and a light pipe having a first transmitting member and a second transmitting member molded on a rear end of the first transmitting member, the first transmitting member made of transparent material and the second transmitting member made of translucent material.

2. The cable connector assembly as claimed in claim 1, wherein said second transmitting member is exposed out of the insulated shell.

3. The cable connector assembly as claimed in claim 2, wherein said first transmitting member is of fork shape, and comprises a sleeve portion and a cutout through the first transmitting member along a direction perpendicular to a mating direction, and a pair of parallel protrusions are formed on both sides of the cutouts.

4. The cable connector assembly as claimed in claim 3, wherein the cable connector assembly further comprises a ring member, the ring member includes a loop portion on a front end thereof and a retaining portion behind the loop portion, said retaining portion has a larger length than said loop portion, said retaining portion defines a plurality of tubers and channels in stagger relationship.

5. The cable connector assembly as claimed in claim 4, wherein said loop portion has an external diameter becoming more and more large along a front-to-back direction, and at least one of said tubers has a bigger external diameter than a rear end of the loop portion, said loop portion is received in an interior of the second transmitting member.

6. The cable connector assembly as claimed in claim 5, wherein the protrusions are perpendicular to the printed circuit board, one of the protrusions has a recess neighboring to the printed circuit board, and the recess is aligned with the LED on the printed circuit board.

7. The cable connector assembly as claimed in claim 6, wherein the mating member has a through hole aligning with a central hole of the printed circuit board, and at least two LEDs are arranged on both sides of the central hole.

8. The cable connector assembly as claimed in claim 7, wherein the printed circuit board defines a first conductive area and a second conductive area disposed on opposite edges thereof, the first conductive area is arranged in an aperture, and the second conductive area is disposed on an upright side of the printed circuit board.

9. The cable connector assembly as claimed in claim 8, wherein the protrusion defines a gibbous block on an exterior side thereof, and the insulative shell defines a groove receiving the gibbous block.

10. The cable connector assembly as claimed in claim 2, wherein the cable connector assembly further comprises a detective contact connecting with the cable, said detective contact is received in a through hole of the mating member and has a part extending beyond the printed circuit board and inserted into a central hole of the printed circuit board.

11. A method of assembling a cable connector assembly, comprising the steps of:

providing a first transmitting member made of transparent material;

molding a second transmitting member on a rear end of the first transmitting member to form a light pipe, and the second transmitting member made of untransparent material;

providing a mating member, a printed circuit board with a LED, a cable and a ring member, the cable electrically connected with the mating member and the printed circuit board, the light pipe enclosing a front end of the cable, the ring member located in the light pipe and neighboring to an interior wall of the light pipe;

assembling the aforementioned components into an insulated shell, with the second transmitting member exposed out of the insulated shell.

12. A method of assembling a cable connector assembly as claimed in claim 11, wherein said mating member includes a cylindrical housing with a receiving cavity therein.

13. A method of assembling a cable connector assembly as claimed in claim 12, wherein said second transmitting member comprises a base portion and an enlarged portion extending forwards from the base portion, the enlarged portion has a larger diameter than the base portion.

14. A method of assembling a cable connector assembly as claimed in claim 13, wherein said enlarged portion is shielding a rear end of a sleeve portion of the first transmitting member.

15. An electrical cable connector comprising:

a mating member;

an internal printed circuit board located behind the mating member with an LED thereon;

a cable connected to and located behind the printed circuit board;

a light pipe coupling to the LED; and a shell enclosing the printed circuit board and a portion of the light pipe; wherein the light pipe includes an interior section hidden under the shell and coupling to the LED, and an exterior section exposed out of the shell for viewing under condition that the interior section and the exterior section own different color characters, respectively.

16. The electrical cable connector as claimed in claim 15, wherein one of the interior section and the exterior section is transparent while the other is translucent.

17. The electrical cable connector as claimed in claim 15, wherein the interior section is transparent while the exterior section is translucent.

18. The electrical cable connector as claimed in claim 17, wherein the LED is colorful.

19. The electrical cable connector as claimed in claim 15, wherein the exterior section and the interior section are unified together via two-shot molding.

20. The electrical cable connector as claimed in claim 15, wherein the exterior section is located at a rear end of the shell and rearwardly confronts a ring member which retains the light pipe in the shell in position.

* * * * *